US007614823B2

(12) United States Patent
Kim et al.

(10) Patent No.: US 7,614,823 B2
(45) Date of Patent: Nov. 10, 2009

(54) DRAIN BOARD INSTALLING DEVICE WITHOUT ANCHOR PLATE

(75) Inventors: Gan-Joo Kim, Jeonju-Si (KR); Gyo-Byum Jin, Jeonju-Si (KR); Jae-Ok Lee, Jeonju-Si (KR); Dae-Gwang Yoon, Jeonju-Si (KR)

(73) Assignee: June Construction Co., Ltd., Jeonju-Si (KR)

( * ) Notice: Subject to any disclaimer, the term of this patent is extended or adjusted under 35 U.S.C. 154(b) by 0 days.

(21) Appl. No.: 12/335,455

(22) Filed: Dec. 15, 2008

(65) Prior Publication Data

US 2009/0196691 A1 Aug. 6, 2009

(30) Foreign Application Priority Data

Feb. 1, 2008 (KR) ..... 10-2008-0010603

(51) Int. Cl.
*E02B 11/00* (2006.01)

(52) U.S. Cl. ..... 405/50; 405/43; 405/232

(58) Field of Classification Search ..... 405/43, 405/44, 45, 50, 232
See application file for complete search history.

(56) References Cited

U.S. PATENT DOCUMENTS 4,755,080 A * 7/1988 Cortlever et al. ..... 405/50
5,439,326 A * 8/1995 Goughnour et al. ..... 405/50
5,584,603 A * 12/1996 Cortlever ..... 405/50
5,658,091 A * 8/1997 Goughnour et al. ..... 405/50
6,039,508 A * 3/2000 White ..... 405/50
6,543,966 B2 * 4/2003 White ..... 405/50
6,908,259 B1 * 6/2005 Tomlinson ..... 405/45
2005/0141964 A1 * 6/2005 Tomlinson ..... 405/50
2008/0080932 A1 * 4/2008 Morizot et al. ..... 405/50

* cited by examiner

*Primary Examiner*—Frederick L Lagman
(74) *Attorney, Agent, or Firm*—Birch, Stewart, Kolasch & Birch, LLP

(57) ABSTRACT

A drain board installing device without an anchor plate is disclosed. A drain board temporary clamp device 146 comprises a protrusion body 321 provided at the center part of an inner wall of the through hole below the drain casing; a plate shaped arm 333 provided with a slit to allow the arm to ascend and descend at a predetermined length along a longitudinal direction of the drain casing within the through hole of the drain casing under the guide of the protrusion; and a T shaped rod 335 fixed to a lower part of the plate shaped arm, wherein, when the plate shaped arm 333 and the T shaped rod 335 descend toward the lower end of the drain casing within the maximum range by means of their load, a lower end part 333*a* of the plate shaped arm descends to the part where a lower end part 204*a* of the drain casing is located, and when the plate shaped arm 333 and the T shaped rod 335 move toward the upper end of the drain casing within the maximum range by means of their load, a T shaped end part 335*a* of the rod is caught in a slit 154 formed in the lower end part of the drain casing.

3 Claims, 10 Drawing Sheets

DRAIN BOARD INSTALLING DEVICE WITHOUT ANCHOR PLATE

TECHNICAL FIELD

The present invention relates to a drain board installing device which installs a drain board in the ground, the drain board being used to improve the weak ground or the swampy land, and more particularly, to a drain board installing device having a drain board temporary clamp device, which can support the drain board in a simple structure without power and allow the drain board to be installed in the ground.

BACKGROUND ART

A drain board installing device that can install a drain board in the ground without an anchor plate is disclosed in the cited reference 1 (Korean Patent No. 622233) and the cited reference 2 (Korean Patent No. 720079).

Such a conventional drain board installing device without an anchor plate includes a leader 102, a drain casing clamp holder 103, a drain casing 104, and a reel device 106, as illustrated in FIG. 1, wherein the drain casing 104 is provided with a drain board temporary clamp device 46 at the end.

The leader 102 is installed in a main body of the drain board installing device so as to adjust its angle, and the drain casing clamp holder 103 is provided to ascend and descend along an up and down direction of the leader 102.

The drain casing clamp holder is fixed to a pulley 144 where wire 133 is wound, and thus is driven indirectly by a hydraulic cylinder 145. Alternatively, the drain casing clamp holder may be provided to insert or take the drain casing into or out of the ground by using other method.

The drain casing 104 is provided with a through hole 108 therein, and is provided with a drain board temporary clamp device 46 in its lower body.

The conventional drain board temporary clamp device 46, as illustrated in FIG. 2, includes a rod shaped support 47 supporting a drain board 105 descended to the lower end through the through hole 108, an arm 48 provided to space apart from the support at a certain distance (0.5 m~1 m) toward a vertical downward direction from a lower opening of the drain casing, and a spring device 50 advancing and retracting the arm.

The spring device 50 is provided to insert a spring 51 into a moving path 52 of the arm formed inside the spring device and elastically support the arm through the spring 51.

The end of the drain board 105 supplied into the through hole 108 of the drain casing is fixed between the lower opening of the drain casing and the support 47 of the drain board temporary clamp device 46. As illustrated in FIG. 3, the drain casing 104 where the drain board 105 is fixed to the end is inserted into the ground through a drainage layer 11, a cover layer 10, and a weak ground 9, wherein the drainage layer 11 is installed for safety and drainage of the drain board installing device. Since earth and sand pile up when the drain casing 104 inserted into the ground is taken out of the ground, the arm 48 of the temporary clamp device and the support 47 push the end of the drain board until the end of the drain board is fixed to the ground.

After the drain casing is taken out of the ground, if a part C of the drain board exposed on the ground is cut, the drain board 105 only remains in the ground. Since the drain board 105 remaining in the ground drains the water of the weak ground layer through the drainage layer 11 in accordance with load pressure of upper materials and capillary phenomenon, the drain board 105 acts to enhance a support power of the weak ground.

However, the aforementioned drain board installing device 101 has a problem as follows, That is, fine-grained earth water flows into the moving path 52 of the arm through a part marked with a circle of FIG. 2, i.e., a part where the arm 48 slides in an airtight state when the drain board installing device 101 inserts the drain casing into the ground. In this case, the moving path of the arm is filled with the fine-grained earth water. If the drain board installing device 101 is used for a long time, a function of the drain board temporary clamp device 46 is remarkably deteriorated or damaged.

Also, when the drain board temporary clamp device is out of order, a problem occurs in that it is inconvenient to repair and detach the drain board temporary clamp device.

(Cited Reference 1)

Korean Patent No. 622233

(Cited Reference 2)

Korean Patent No. 720079

DETAILED DESCRIPTION OF THE INVENTION

Technical Problems

The present invention is directed to a drain board installing device, which substantially obviates one or more problems due to limitations and disadvantages of the related art. An object of the present invention is to provide a drain board installing device, in which a drain board temporary clamp device is little out of order even if it is used for a long time.

Another object of the present invention is to provide a structure of a drain board temporary clamp device, in which a drain board is simply fixed to a lower end of a drain casing without separate power so that the drain board is inserted into the ground.

Other object of the present invention is to provide a structure of a drain board temporary clamp device of which detachment and repair are convenient.

Technical Solutions

In order to achieve the above objects, in a drain board installing device without an anchor plate, which includes a drain casing clamp holder provided to ascend along a leader, a drain casing fixed to the drain casing clamp holder, having a through hole, a reel device supplying a drain board through the through hole of the drain casing, and a drain board temporary clamp device provided in the drain casing, the drain board temporary clamp device comprises a protrusion body provided at the center part of an inner wall of the through hole below the drain casing; a plate shaped arm provided with a slit to allow the arm to ascend and descend at a predetermined length along a longitudinal direction of the drain casing within the through hole of the drain casing under the guide of the protrusion; and a T shaped rod fixed to a lower part of the plate shaped arm, wherein, when the plate shaped arm and the T shaped rod descend toward the lower end of the drain casing within the maximum range by means of their load, a lower end part of the plate shaped arm descends to the part where a lower end part of the drain casing is located, and when the plate shaped arm and the T shaped rod move toward the upper end of the drain casing within the maximum range by means of their load, a T shaped end part of the rod is caught in a slit formed in the lower end part of the drain casing.

A support plate is further provided in the drain casing, and the protrusion body is fixed between the support plate and an inner wall of the through hole at a lower end of the drain casing.

An opening at the lower end of the drain casing is eccentric so that the plate shaped arm and the T shaped rod move in parallel with the inner wall of the through hole at the lower end of the drain casing, to which the protrusion body is fixed.

ADVANTAGEOUS EFFECTS

The present invention provides a drain board temporary clamp device that can descend by means of load along a slit formed in a plate shaped arm. In this case, when the slot is stoppered in a protrusion body provided at a sidewall inside a drain casing as the plate shaped arm descends within the maximum range, the lower end of the arm is substantially flush with that of the drain casing, whereby damage or defect of the drain board temporary clamp device can be reduced, and earth and sand can be prevented from being penetrated into the drain casing.

Also, the present invention provides a drain board temporary clamp device that can simply insert a drain board into the ground without an anchor plate.

BEST MODE FOR CARRYING OUT THE INVENTION

Hereinafter, technical structure and operation of a drain board installing device that can install a drain board in the ground without an anchor plate will be described in detail with reference to FIG. 4 to FIG. 8.

Figure 1:
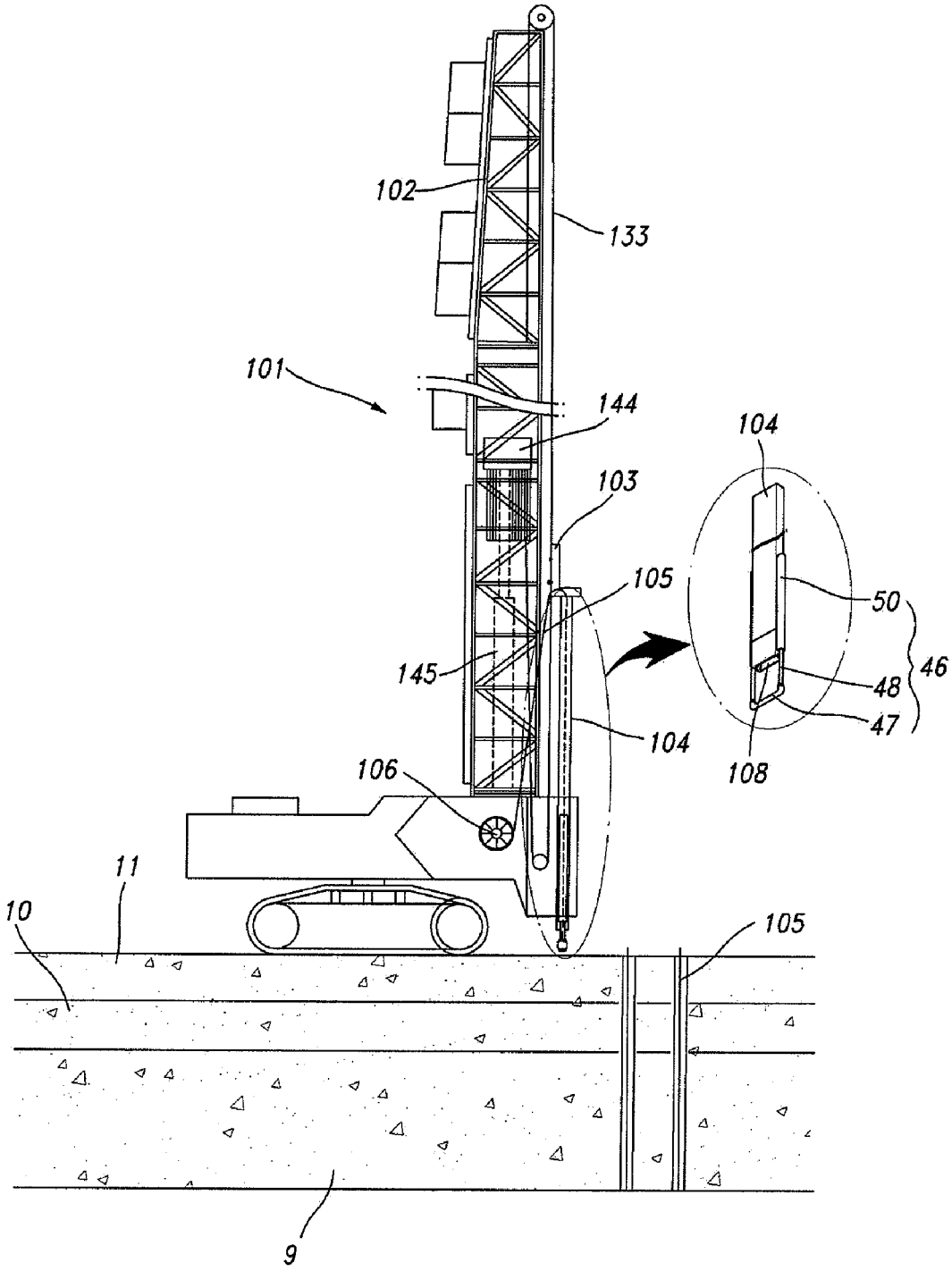
Fig 1 Prior Art
FIG. 1 is a diagram illustrating a structure of a conventional drain board installing device without an anchor plate.
Figure 2:
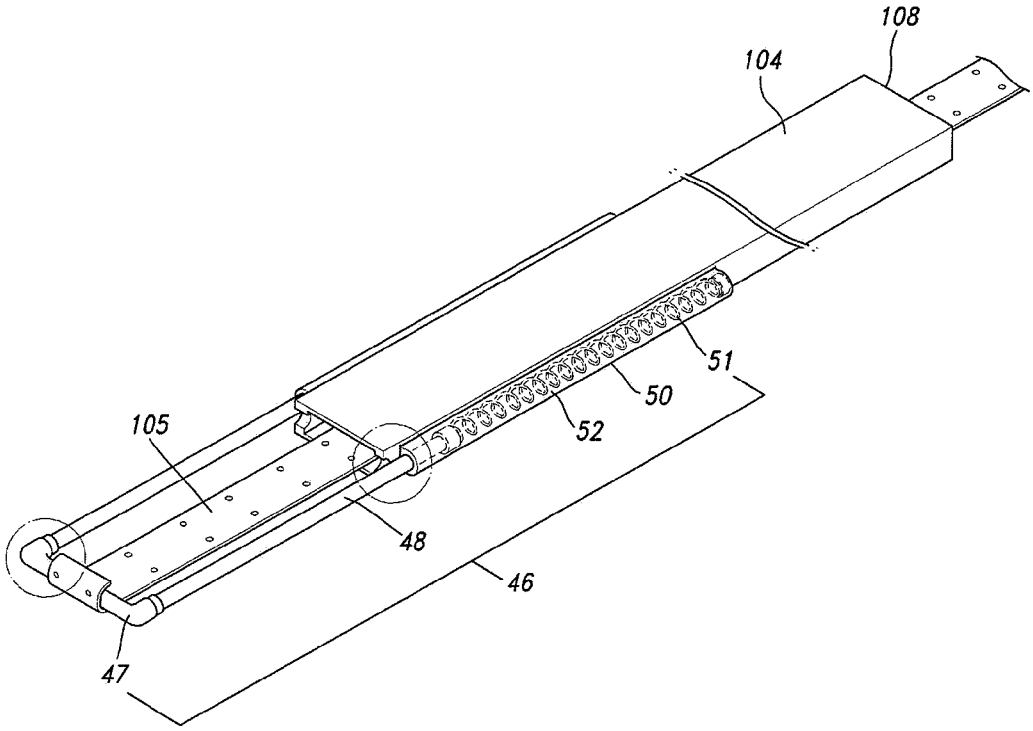
Fig 2 Prior Art
FIG. 2 is a diagram illustrating an example of a conventional drain board temporary clamp device provided in a drain casing.
Figure 3:
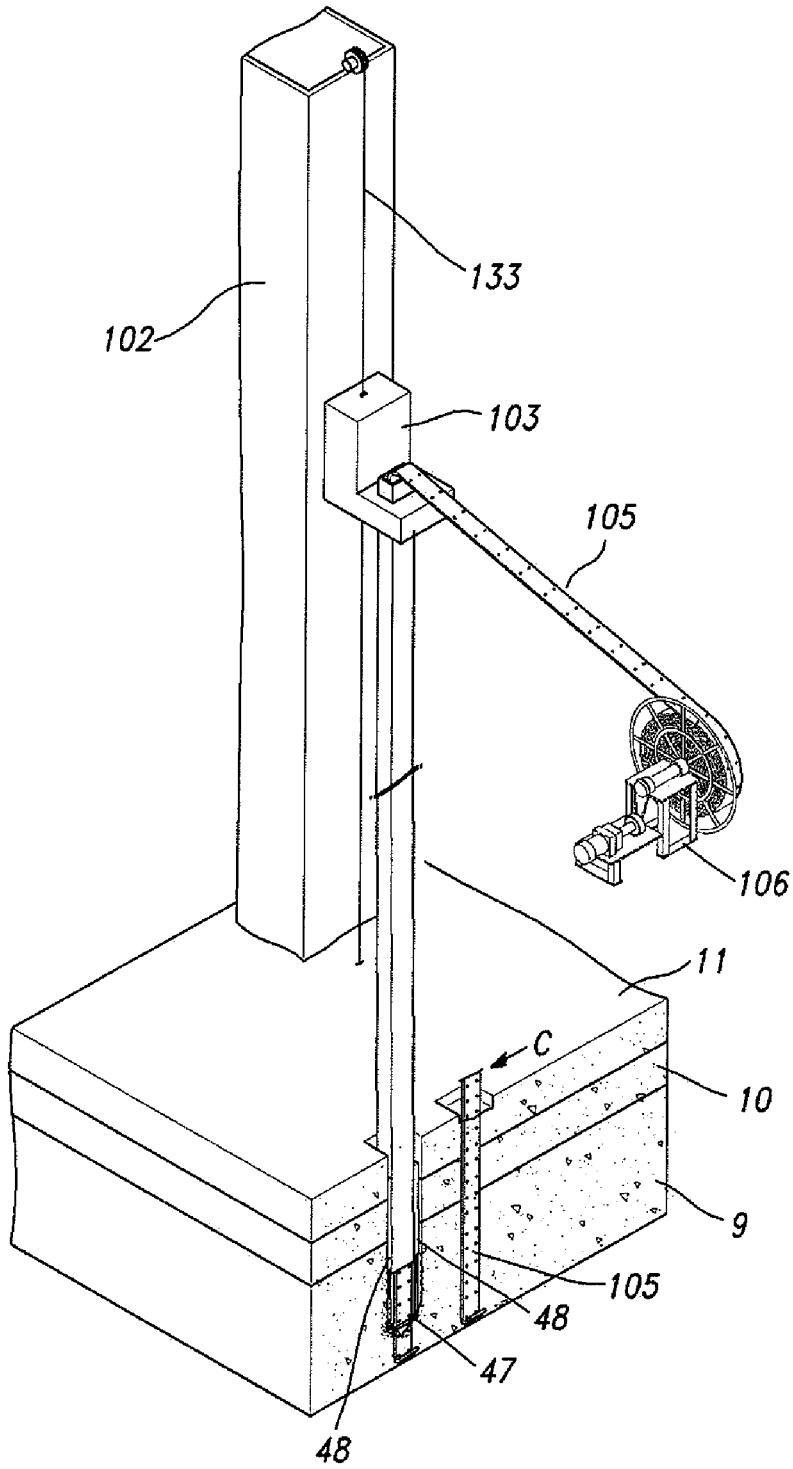
Fig 3 Prior Art
FIG. 3 is a diagram illustrating a state that a drain board is installed in the ground using the device of FIG. 1.
Figure 4:
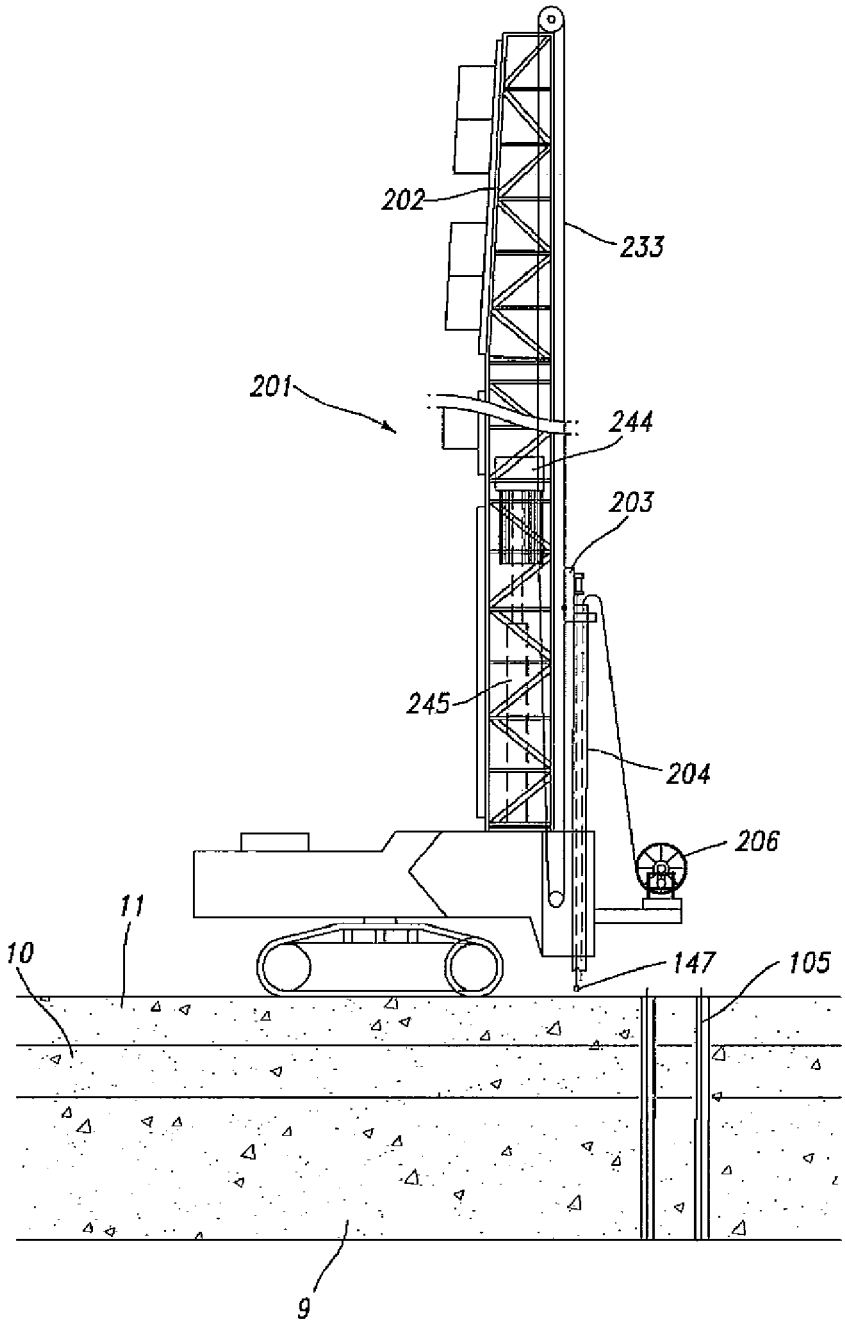
FIG. 4 is a diagram illustrating a structure of a drain board installing device according to the present invention.
Figure 5:
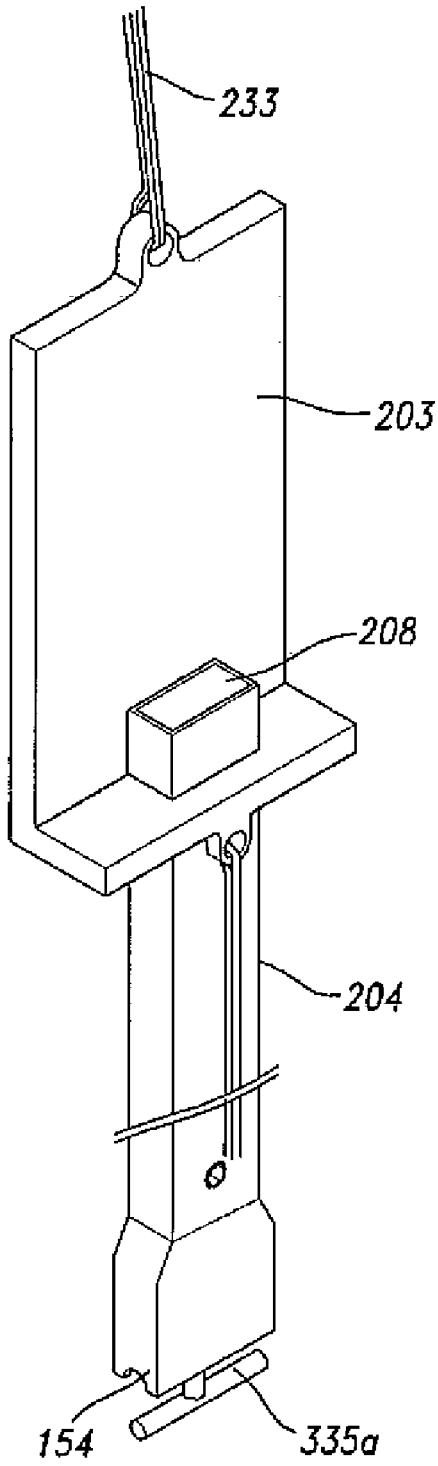
FIG. 5 is an elevational view illustrating a main part of a drain board temporary clamp device provided in a drain casing of the present invention.
Figure 6:
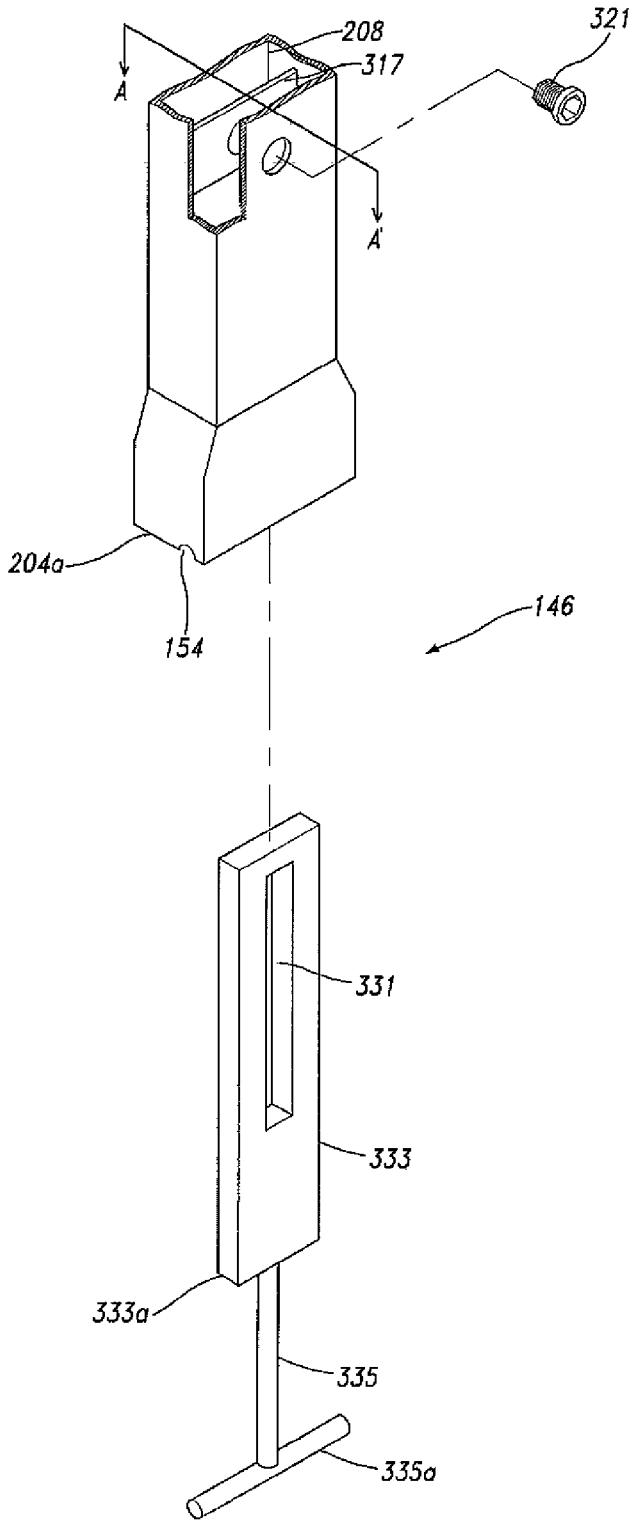
FIG. 6 is an exploded perspective view illustrating a main part of a drain board temporary clamp device provided in a drain casing of the present invention.
Figure 7:
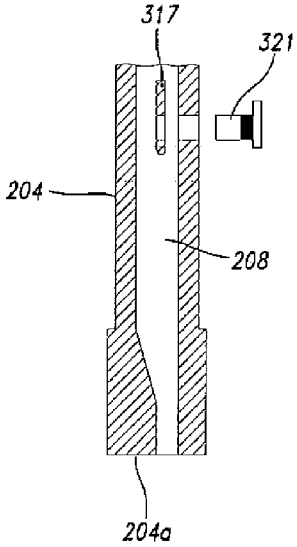
FIG. 7 is a sectional view taken along line A-A' of FIG. 6.

FIG. 4 is a diagram illustrating a structure of a drain board installing device according to the present invention, FIG. 5 is an elevational view illustrating a main part of a drain board temporary clamp device provided in a drain casing of the present invention, FIG. 6 is an exploded perspective view illustrating a main part of a drain board temporary clamp device provided in a drain casing of the present invention, FIG. 7 is a sectional view taken along line A-A' of FIG. 6 in a state that a plate shaped arm and a T shaped rod are excluded, and FIG. 8*a* to FIG. 8*e* are diagrams illustrating a driving procedure of a drain board temporary clamp device provided in a drain casing of the present invention.

A drain board installing device 201 of the present invention includes a leader 202, a drain casing clamp holder 203, a drain casing 204, and a reel device 206, wherein the drain casing 204 is provided with a drain board temporary clamp device 146.

The reel device 206 is provided to allow its reel to be reversely rotated if it pulls the reel at a force more than a set tension (for example, 4~10 kg).

The leader 202 is installed in a main body of the drain board installing device so as to adjust its angle, and the drain casing clamp holder 203 is provided to ascend and descend along an up and down direction of the leader 202.

The drain casing clamp holder is fixed to a wire 233 wound in a pulley 244. The drain casing clamp holder is provided to ascend by means of either a hydraulic cylinder 245, which drives the pulley, or other separate method, which is known.

The drain casing 204 is detachably fixed to the drain casing clamp holder 203.

The drain casing 203 is provided with a through hole 208 therein, and the drain board temporary clamp device 146 of the present invention is provided below the drain casing provided with the through hole.

The drain board temporary clamp device 146 of the present invention includes a protrusion body 321 provided at the center part of an inner wall of the through hole below the drain casing, a plate shaped arm 333 provided with a slit 331 to allow the arm to ascend and descend at a predetermined length along a longitudinal direction of the drain casing within the through hole of the drain casing under the guide of the protrusion, and a T shaped rod 335 fixed to a lower part of the plate shaped arm, wherein the plate shaped arm and the T shaped rod are formed in a single body with each other. When the plate shaped arm 333 and the T shaped rod 335 descend toward the lower end of the drain casing within the maximum range by means of their load, a lower end part 333*a* of the plate shaped arm descends to the part where a lower end part 204*a* of the drain casing is located. When the plate shaped arm 333 and the T shaped rod 335 move toward the upper end of the drain casing within the maximum range by means of their load, a T shaped end part 335*a* of the rod is caught in a slit 154 formed in the lower end part of the drain casing.

As described above, the reason why the plate shaped arm and the T shaped rod constitute the drain board temporary clamp body is to reduce an area affected by earth pressure when the T shaped rod is exposed from the ground, and to allow the end part of the plate shaped arm to shield an opening of the drain casing in a state that the T shaped rod is exposed to the outside of the drain casing. Accordingly, although not shown, the end part 333*a* of the plate shaped arm may be formed thickly to easily shield the opening.

The slit 331 which controls the moving distance of the drain board temporary clamp device can have a length within the range of 0.3 m~1 m, and the overall weight of the drain board temporary clamp device should be set to be smaller than tension of the reel device. For example, the difference between tension of the reel device and the weight of the drain board temporary clamp device is preferably set to the range smaller than or greater than 2~3 kg.

The protrusion body 321 which guides movement of the plate shaped arm 333 may be provided in a bolt type, and its end is fixed to a support plate 317 provided inside the drain casing to maintain firmness and stableness.

Meanwhile, when the end part 335*a* of the T shaped rod is in contact with a groove 154 formed at the lower end part of the drain casing 204, it protrudes (0.5 mm) a little toward the outside at both sides of the body of the drain casing. Alternatively, the end part 335*a* of the T shaped rod is formed in the body part of the drain casing to shield the opening.

Also, it is preferable that the opening provided in the lower end part 204*a* of the drain casing is eccentric as illustrated in FIG. 7 so that the drain board temporary clamp device 146 moves in parallel with the longitudinal direction of the drain casing.

The end part 335*a* of the T shaped rod is provided to shield a sectional part of the opening at the lower end of the drain casing excluding a gap to which the drain board can be fitted when the end part 335*a* is in contact with the lower end part of the drain casing. In this case, the earth and sand can be prevented from flowing into the through hole 208.

Since the through hole of the drain casing 204 maintains a sufficient space (about 20~40 mm), even though the opening at the lower end of the drain casing is not sealed tightly, the small grained earth and sand penetrated into the through hole are drained as soon as the drain casing is taken out of the ground. Therefore, the through hole is not blocked by the earth and sand.

The procedure of installing the drain board in the ground without an anchor plate by using the aforementioned drain board temporary clamp device will be described in detail with reference to FIG. 5*a* to FIG. 8*e*.

Figure 8A:
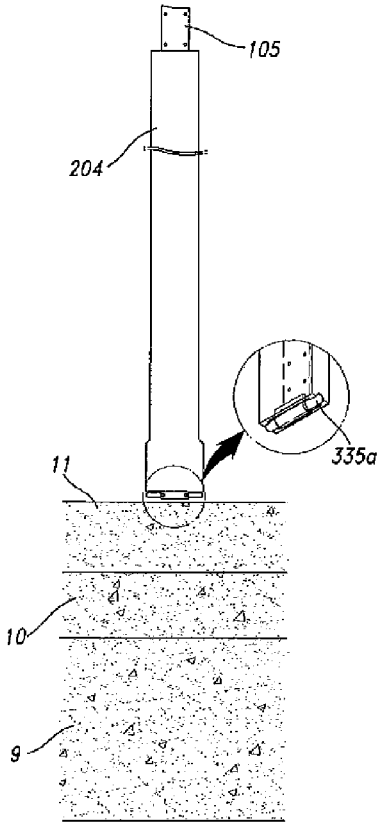
FIG. 8*a* to FIG. 8*e* are diagrams illustrating a driving procedure of a drain board temporary clamp device provided in a drain casing of the present invention.

First of all, as illustrated in FIG. 8*a*, the end part 335*a* of the T shaped rod of the drain board temporary clamp device 146 provided at the lower end part of the drain casing 204 is wrapped with the end part of the drain board 105 in a U shape. Then, if a worker inserts the T shaped rod wrapped in a U shape at the opening of the drain casing into the drain casing, the drain board is tightly pulled by driving tension of the reel device 206. In this case, as the T shaped rod, which wraps the end part of the drain board, is caught in the end part of the drain casing, the drain board is fixed and at the same time the T shaped rod part wrapping the drain board shields the opening at the lower end of the drain casing so as to prevent the earth and sand from being penetrated into the through hole.

Figure 8B:
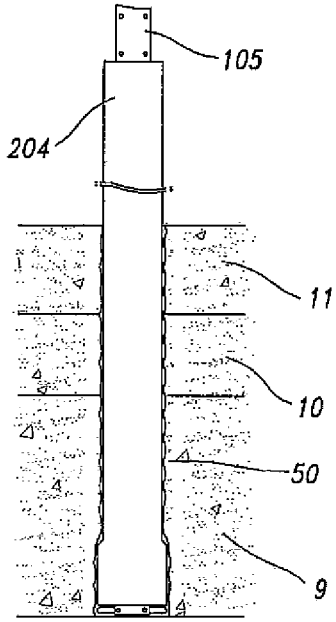

Subsequently, the drain casing 204 is inserted into the ground at a predetermined depth as illustrated in FIG. 8*b*.

Afterwards, if the drain casing 204 is taken out of the ground, the end part of the drain board 105 remains in the ground as illustrated in FIG. 5*c*. The drain board temporary clamp device supports the end part of the drain board by means of its load without being taken out of the ground along with the drain casing 204 until the upper end of the slit 331 formed in the plate shaped arm is caught in the protrusion body 321.

Figure 8C:
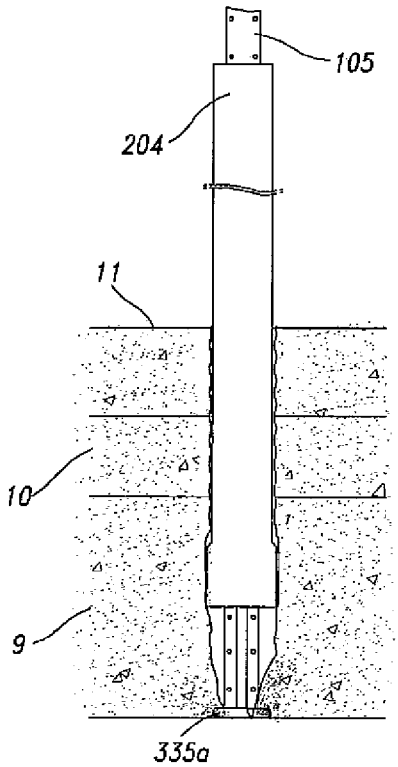
Figure 8D:
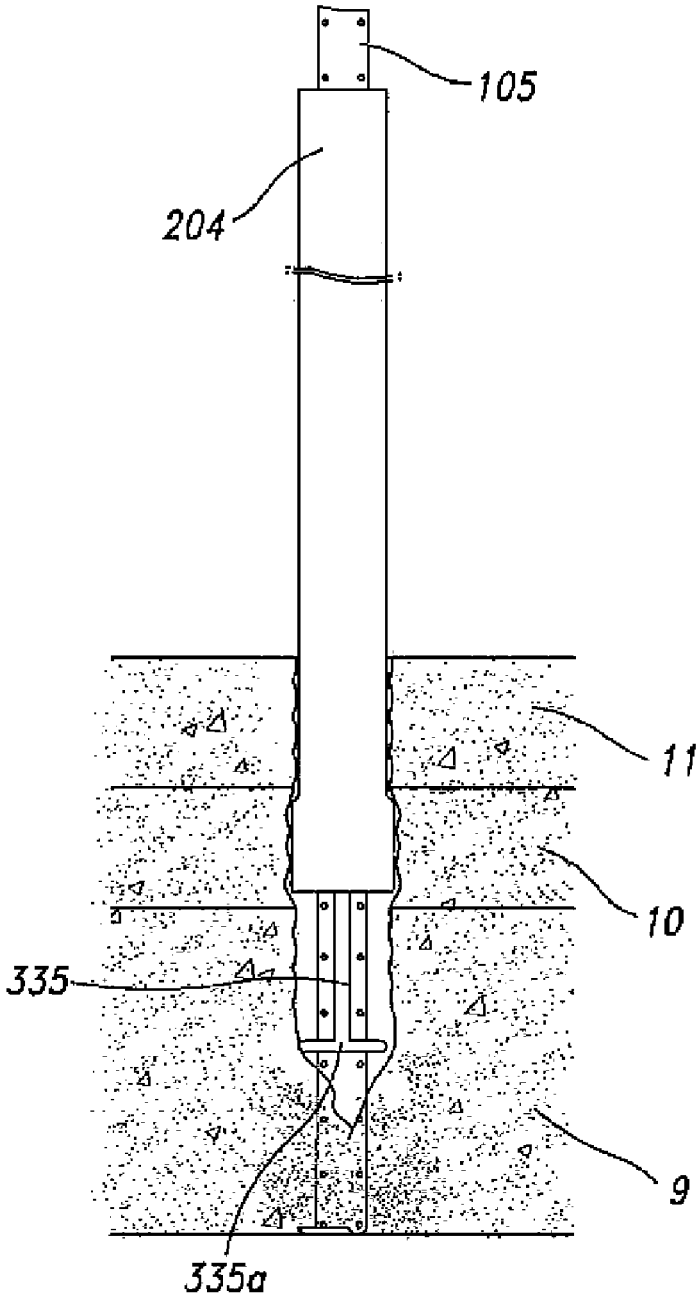

If the drain casing 204 is taken out of the ground while the T shaped rod of the drain board temporary clamp device is pushing the end part of the drain board 105 as illustrated in FIG. 8*c*, the through hole where the drain casing is located is rapidly filled with the earth and sand, and the end part of the drain board is buried in the ground by the earth and sand and then fixed to the ground.

If the drain casing 204 continues to be taken out of the ground in a state of FIG. 8*c*, the T shaped rod 335 which pushes the end part of the drain board 105 is detached from the end part of the drain board as illustrated in FIG. 5*d* and starts to be taken out of the ground together with the drain casing.

Figure 8E:
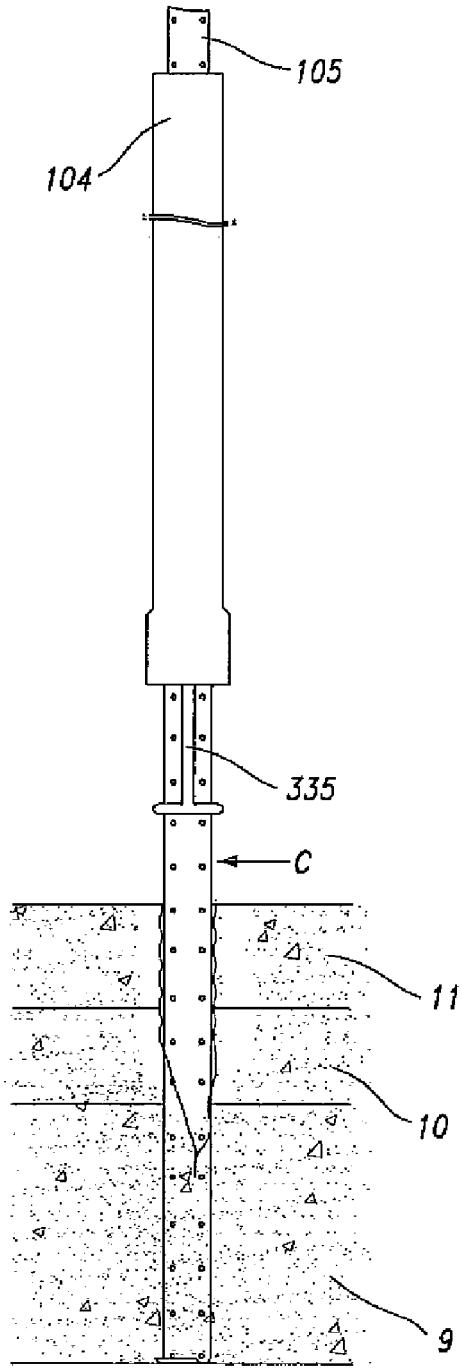

Subsequently, after the drain casing 204 and the drain board temporary clamp device are taken out of the ground as illustrated in FIG. 8*e*, the worker cuts a part C of the drain board 105 and then fixes the end part of the drain board to the drain casing through the procedure of FIG. 9*a*. Then, the worker repeats the same operation by moving the location of the drain casing.

The drain board installing device without an anchor plate according to the present invention is not limited to the aforementioned structure as illustrated. Various modifications can be made in the drain board installing device of the present invention within the claims and objects of the present invention.

What is claimed is:

1. A drain board installing device without an anchor plate, which includes a drain casing clamp holder provided to ascend along a leader, a drain casing fixed to the drain casing clamp holder, having a through hole, a reel device supplying a drain board through the through hole of the drain casing, and a drain board temporary clamp device provided in the drain casing, the drain board temporary clamp device comprising:

a protrusion body provided at the center part of an inner wall of the through hole below the drain casing;

a plate shaped arm provided with a slit to allow the arm to ascend and descend at a predetermined length along a longitudinal direction of the drain casing within the through hole of the drain casing under the guide of the protrusion; and a T shaped rod fixed to a lower part of the plate shaped arm, wherein, when the plate shaped arm and the T shaped rod descend toward the lower end of the drain casing within the maximum range by means of their load, a lower end part of the plate shaped arm descends to the part where a lower end part of the drain casing is located, and when the plate shaped arm and the T shaped rod move toward the upper end of the drain casing within the maximum range by means of their load, a T shaped end part of the rod is caught in a slit formed in the lower end part of the drain casing.

2. The drain board installing device without an anchor plate as claimed in claim 1, wherein a support plate is further provided in the drain casing, and the protrusion body is fixed between the support plate and an inner wall of the through hole at a lower end of the drain casing.

3. The drain board installing device without an anchor plate as claimed in claim 1, wherein an opening at the lower end of the drain casing is eccentric so that the plate shaped arm and the T shaped rod move in parallel with the inner wall of the through hole at the lower end of the drain casing, to which the protrusion body is fixed.

* * * * *